United States Patent [19]

Hirabayashi et al.

[11] Patent Number: 4,760,016

[45] Date of Patent: Jul. 26, 1988

[54] SILVER HALIDE COLOR PHOTOGRAPHIC LIGHT-SENSITIVE MATERIAL

[75] Inventors: Shigeto Hirabayashi; Kaoru Matsunaga, both of Hino, Japan

[73] Assignee: Konishiroku Photo Industry Co., Ltd., Tokyo, Japan

[21] Appl. No.: 918,762

[22] Filed: Oct. 14, 1986

[30] Foreign Application Priority Data

Oct. 17, 1985 [JP] Japan ..... 60-232128

[51] Int. Cl.[4] ..... B03C 1/46

[52] U.S. Cl. ..... 430/505; 430/544; 430/957

[58] Field of Search ..... 430/957, 544, 505

[56] References Cited

U.S. PATENT DOCUMENTS

| | | | |
|---|---|---|---|
| 4,248,962 | 2/1981 | Lau | 430/382 |
| 4,414,308 | 11/1983 | Hamada | 430/505 |
| 4,461,826 | 7/1984 | Yamashita | 430/505 |
| 4,500,633 | 2/1985 | Menjo | 430/505 |
| 4,524,130 | 6/1985 | Iwasa | 430/505 |
| 4,526,863 | 7/1985 | Mihayashi | 430/505 |
| 4,564,591 | 1/1986 | Tanaka et al. | 430/567 |

*Primary Examiner*—Paul R. Michl
*Assistant Examiner*—Patrick A. Doody
*Attorney, Agent, or Firm*—Jordan B. Bierman

[57] ABSTRACT

A silver halide color photographic light sensitive material is disclosed, which is excellent in the resistance to the back contamination of the processing liquid. The color photographic material comprises a support having thereon photographic component layers containing at least one silver halide emulsion layer. The emulsion containing at least one emulsion layer of the photographic component layers is a surface latent image forming type silver chloride or silver chloro-brobromide emulsion. And at least one of the photographic component layers contains at least one compound selected from the compounds represented by the formula [I]:

$$A-(TIME)n-Z \qquad [I]$$

in which A is a coupler component capable of coupling with the oxidized product of a color developing agent, Z is a component capable of releasing from A upon the coupling reaction of A with the oxidized product of the color developing agent and inhibiting the development of the silver halide, and Z has at least one hydrophilic group. TIME is a timing group capable of releasing together with Z from A upon the coupling reaction of A with the oxidized product of a color developing agent, and then releasing Z, and n is 0 or 1.

8 Claims, No Drawings

SILVER HALIDE COLOR PHOTOGRAPHIC LIGHT-SENSITIVE MATERIAL

FIELD OF THE INVENTION

The present invention relates to a silver halide color photographic light-sensitive material which is excellent in the resistance to the mixing-in of different processing liquid components (so-called back contamination).

BACKGROUND OF THE INVENTION

The processing of a silver halide color light-sensitive material is comprised basically of two processes; i.e., color developing and desilvering processes. The desilvering process is comprised of bleaching and fixing processes or of a bleach-fix process. Besides, additional processes such as rinsing, stabilization, and the like processes are used.

In recent years, these developing processes have been generally carried out either continuously (running processing) or intermittently in automatic processors by photofinishers.

There is an important problem in the running processing or intermittent processing by use of such automatic processors. It is the increase in the mixing-in and accumulation of different processing liquid components. This becomes conspicuous when the processing liquid's replenishing amount becomes reduced to lower the degree of renewing the tank liquid with a replenisher, and it becomes more conspicuous when combined with the prolongation of the using term of the liquid. The above-mentioned 'mixing-in of a different processing solution' is caused by carrying into the developer solution, immediately after the development, of the subsequent processing solution's component (so-called 'back contamination') by the splash, transport leader, or film hanger inside an automatic processor. Of these mixing-in components, the thiosulfate ion as a fixer accelerates the developement. That is, this problem strongly occurs particularly when a photographic material is bleach-fixed directly after being color-developed. Especially, the shoulder portion of a photographic characteristic curve is enhanced, thus resulting in the formation of a significantly high-contrast image. And the increase in the mixing-in of a metallic salt as a fixing agent, particularly a ferric salt, accelerates the decomposition of hydroxylamine as a preservative to thereby produce ammonia ions. The production of the ammonia ion also accelerates physical development just as the thiosulfate ion does, so that is is disadvantageous in respect of forming a high-contrast image.

As for the prior art for the improvement on the variation of photographic characteristics due to the mixing-in of a different processing liquid's component, as far as we know, there have been no substantially improved examples in light-sensitive materials. On the other hand, it is the status quo that there exist almost no techniques for improving processing solutions to thereby improve the above variation of photographic characteristics. Although there are only a few techniques for chelating the heavy metallic ion slightly present in a bleach-fix bath as described in, e.g., U.S. Pat. Nos. 3,839,045, 3,746,544, 4,264,716, and the like, the improving extent by these techniques is small and still not satisfactory.

SUMMARY OF THE INVENTION

It is therefore an object of the present invention to provide a stable silver halide color photographic light-sensitive material which is capable of being stably processed and whose photographic characteristics are maintained constant even when the mixing-in of a different liquid's component (back contamination) occurs during the development thereof.

The above object is accomplished by a silver halite color photographic light-sensitive material comprising a reflective support having thereon photographic component layers containing at least one silver halide photographic emulsion layer, in which the silver halide emulsion layer comprises a surface latent image forming type silver chloride or silver chlorobromide emulsion, and at least one of the photographic component layers contains at least one compound selected from the compound represented by the General Formula [I]:

General Formula [I]

$$A-(TIME)n-Z$$

wherein A is a coupler component being capable of coupling with the oxidized product of a color developing agent and releasing $-(TIME)n-Z$, TIME is a timing group being capable of releasing together with Z from A upon the coupling reaction of A with the oxidized product of a color developing agent and then releasing Z, n is 0 or 1, and Z is a component being capable of releasing from TIME and inhibiting the development of the silver halide, which has at least one hydrophilic group.

The more preferred embodiment of this invention is such that the Formula [I]-having compound content of the silver halide color photographic light-sensitive material is from 0.0001 mole to 0.005 mole per mole of the silver thereof.

In this specification, the 'silver chlorobromide emulsion' implies that the emulsion is allowed to contain a slight amount of silver iodide in addition to the silver chlorobromide; for example, it is allowed to contain not more than 0.3 mole %, and more preferably not more than 0.1 mole % silver iodide. However, in this invention, a silver chlorobromide emulsion containing no silver iodide is most preferred.

And the photographic component layers in the silver halide color photographic light-sensitive material of this invention means all the hydrophilic colloid layers, including a subbing layer, interlayers, an overcoat layer, on the light-sensitive emulsion layer-coated side of the support.

DETAILED DESCRIPTION OF THE INVENTION

The present invention will be illustrated further in detail below:

As for the light-sensitive emulsion layers of the silver halide color photographic light-sensitive material of this invention, at least one layer thereof may be comprised of a surface latent image forming type silver chloride or silver chlorobromide emulsion, but it is more desirable that all the light-sensitive emulsion layers be comprised of a silver chloride or silver chlorobromide emulsion.

A silver chloride content is preferably not less than 5 mol %, more preferably not less than 90 mol % and most preferably not less than 99 mol %, because the more the silver chloride content of the above-mentioned silver chlorobromide is, the more the silver chlorobromide may be able to display a remarkable effects of the invention.

In the invention, the term, 'a surface latent image forming type', shall be defined as that, in the cases of the following surface-development (A) and internal-development (B) each processed after exposed to light at a speed of from 1 to 1/100 sec, a sensitivity obtained in the surface-development (A) is faster than that of the international-development (B). Herein, a sensitivity shall be defined as follows:

$$S = 100/Eh$$

wherein S represents a value of sensitivity and Eh represents a value of exposure necessary for obtaining the midpoint of density, $\frac{1}{2}$ (a Dmax+a Dmin), between a maximum density (Dmax) and a minimum density (Dmin).

Surface-development (A):

Developments are made at 20° C. for 10 minutes in the developer having the following formula:

| | |
|---|---|
| N—methyl-p-aminophenol (a hemisulfate) | 2.5 g |
| Ascorbic acid | 10.0 g |
| Sodium metaborate.tetrahydrate | 35.0 g |
| Potassium bromide | 1.0 g |
| Water to be added to make | 1.0 liter |

Internal-development (B):

A processing is made at 20° C. for 10 minutes in a bleaching solution containing potassium ferricyanide in an amount of 3 g/liter and phenosafranine in an amount of 0.0125 g/liter and, after washing for 10 minutes, a development is made at 20° C. for 10 minutes in the developer having the following formula:

| | |
|---|---|
| N—methyl-p-aminophenol (hemisulfate) | 2.5 g |
| Ascorbic acid | 10.0 g |
| Sodium metaborate.tetrahydrate | 35.0 g |
| Potassium bromide | 1.0 g |
| Sodium thiosulfate | 3.0 g |
| Water to be added to make | 1.0 liter. |

Further, the smaller the coating amount of silver, the less the delay in the development due to the increase in bromide and the better in respect that adequate dye formation can be made even in a shorter-period development, and the best results can be obtained when the coating amount of silver is not more than 1 g/m$^2$, and particularly not more than 0.8 g/m$^2$. The color development is desirable to be made at a temperature of not less than 30° C. for not more than 210 seconds, more preferably not less than 33° C. for not more than 150 seconds, and most preferably not less than 35° C. for not more than 120 seconds.

Subsequently, those compounds having Formulas [I] (hereinafter called DIR compounds) will be described in detail below:

In formula [I], A is a coupler component (compound) capable of coupling with the oxidized product of a color developing agent, and examples of the coupler component include open-chain ketomethylene compounds such as acylacetanilides, acylacetic acid esters, etc., dye forming couplers such as pyrazolones, pyrazolotriazoles, pyrazolinobenzimidazoles, indazolones, phenols, naphthols, etc., and substantially not dye-forming coupling components such as acetophenones, indanones, oxazolones, etc., and also include those which, by the coupling reaction, become capable of forming water-soluble and completely diffusible dyes.

In the formula, Z is a component (compound) which splits off with TIME as a result of the reaction of A with a color developing agent and inhibits the development of the silver halide, and preferred examples of the component include heterocyclic compounds such as benzotriazole, 3-octylthio-1,2,4-triazole, etc., and heterocyclic mercapto compounds (having a mercapto group such as 1-phenyltetrazolylthio group, etc.).

Examples of the above heterocyclic group include tetrazolyl groups, thiadiazolyl groups, oxadiazolyl groups, thiazolyl groups, oxazolyl groups, imidazolyl groups, triazolyl groups, and the like, and to be more concrete, 1-phenyl-tetrazolyl group, 1-ethyltetrazolyl group, 1-(4-hydroxyphenyl)-tetrazolyl group, 1,3,4-thiazolyl group, 5-methyl-1,3,4-oxadiazolyl group, benzothiazolyl group, benzoxazolyl group, benzimidazolyl group, 4H-1,2,4-triazolyl group, and the like.

In addition, in Formula [I], Z is linked to the active site of A.

Z has at least one a hydrophilic group such as hydroxy, amino, carboxy or carbamoyl.

The TIME is represented by the following Formulas [II], [III], [IV], [V] and [VI], but it is not limited thereto.

Formula [II]

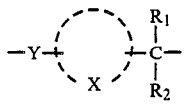

wherein X is a group of atoms necessary to complete a benzene ring or naphthalene ring, Y is

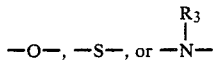

(wherein $R_3$ is a hydrogen atom, an alkyl or aryl group), and is linked to the coupling position, and $R_1$ and $R_2$ each is as defined in the above $R_3$, but the group

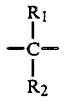

is substituted to Y at the ortho or para position, and is bonded to a hetero atom contained in an inhibitor Z.

Formula [III]

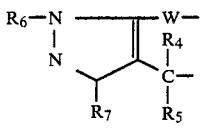

wherein W is a group as defined in the Y of the foregoing Formula [II], and $R_4$ and $R_5$ are as defined in the $R_1$ and $R_2$, respectively, of Formula [II], $R_6$ is a hydrogen atom, an alkyl group, an aryl group, an acyl group, a sulfo group, an alkoxycarbonyl group, or a heterocyclic residue, and $R_7$ is a hydrogen atom, an alkyl group, an aryl group, a heterocyclic residue, an alkoxy group, an amino group, an acylamido group, a sulfonamido group, a carboxy group, an alkoxycarbonyl group, a carbamoyl group or a cyano group. And the timing group is linked by W with A at the coupling position thereof, and bonded by

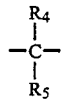

to a hereto atom of an inhibitor Z.

Subsequently, examples of the timing group which releases the inhibitor Z by the intramolecular nucleophilic substitution reaction will be given below, which include those having the following Formulas [IV], [V] and [VI]:

Formula [IV]

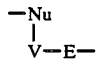

wherein Nu is a nucleophilic group having an electron-rich oxygen, sulfer or nitrogen atom and bonded to the coupling position of A, and E is an electrophilic group having an electron-poor carbonyl, thiocarbonyl, phosphonyl or thiophosphonyl group and linked to the inhibitor Z by bonding with a hetero atom thereof, and V is a linkage group which connects Nu with E three-dimensionally and which, after the Nu is released from A, is subjected to the intramolecular substitution reaction for the three-member ring through seven-member ring formation to thereby release the inhibitor Z, Formula [V]

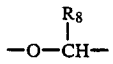

wherein $R_8$ is a hydrogen atom, an alkyl or aryl group, and the oxygen atom is bonded to the coupling position of a coupler A, and the carbon atom is bonded with the nitrogen atom of the inhibitor Z, Formula [VI]

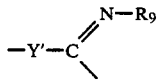

wherein Y' is a group as defined in the Y of Formula [II], $R_9$ is an alkyl, aralkyl, aryl or heterocyclic group, and linked by Y' with the coupler A at the coupling position thereof and bonded through the carbon atom to a hereto atom of the inhibitor Z.

In the invention, as described above, DIR compunds each having a water-soluble group are used in the components of a development inhibitor. It is well known that these DIR compounds are relatively less in effect in the ordinary usage thereof for improving image sharpness. On the contrary, it is really unexpected that a peculiarly great effect thereof can be displayed to prevent the variations of the photographic characteristics due to the BF back contamination.

As has been described, typical examples of the DIR compounds of this invention include those DIR couplers to the active site of which is introduced a group which, when splitting from the active site, is capable of forming a development-inhibitor compound, and these are described in, e.g., British Pat. No. 935,454, U.S. Pat. Nos. 3,227,554, 4,095,984, 4,149,886, Japanese Patent Publication Open to Public Inspection (hereinafter referred to as Japanese Patent O.P.I. Publication) No. 151944/1982, and the like. In the above DIR coupler, when reacting with the oxidized product of a color developing agent, the mother nucleus thereof forms a dye, and at the same time has a nature to release a development inhibitor. The DIR compounds of the present invention also include those compounds which, when coupling with the oxidized product of a color developing agent, release a development inhibitor but not form a dye, and which are described in U.S. Pat. Nos. 3,652,345, 3,928,041, 3,958,993, 3,961,959, 4,052,213, Japanese Patent O.P.I. Publication Nos. 110529/1978, 13333/1979, 161237/1980, and the like. Further, those compounds in which, when reacting with the oxidized product of a color developing agent, the mother nucleus thereof forms a dye or a colorless compound and, on the other hand, the timing group which has split therefrom by the intramolecular nucleophilic substitution reaction or split reaction, releases a development inhibitor; so-called timing DIR compounds, are also included in this invention, and these are described in Japanese Patent O.P.I. Publication Nos. 90932/1977, 145135/1979, 114946/1981, 154234/1982, 205150/1983, 7429/1985, and the like. In addition, those DIR compounds in which, when reacting with the oxidized product of a color developing agent, the coupler's mother nucleus which produces a completely diffusible dye has the above-mentioned timing group linked thereonto, and which are described in Japanese Patent O.P.I. Publication Nos. 160954/1983, 162949/1983, and the like.

The following are typical examples of the DIR compounds of the present invention, but the present invention is not limited by the examples.

[EXEMPLIFIED COMPOUNDS]

(D-1)

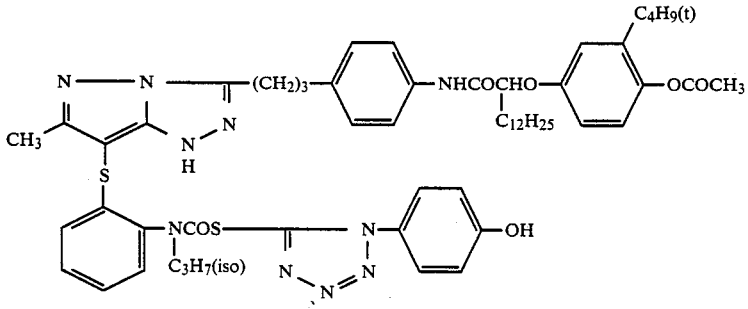

-continued
(D-2)
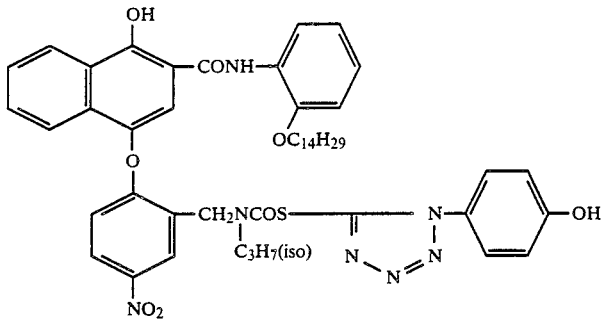
(D-3)
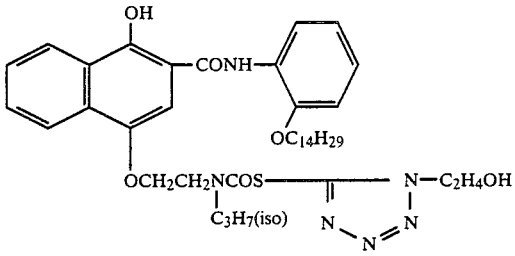
(D-4)
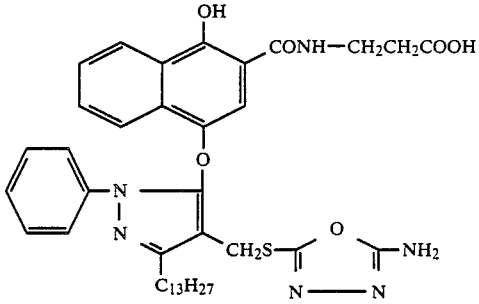
(D-5)
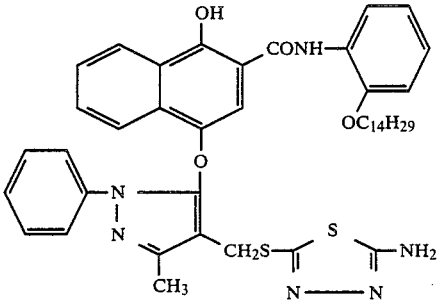
(D-6)
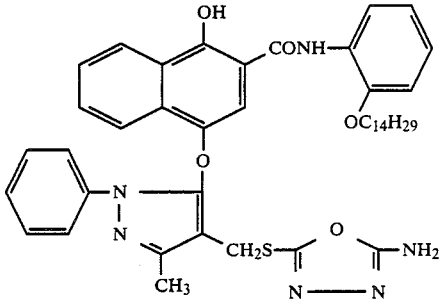
(D-7)
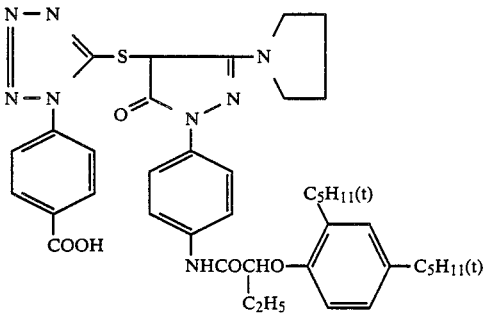
(D-8)
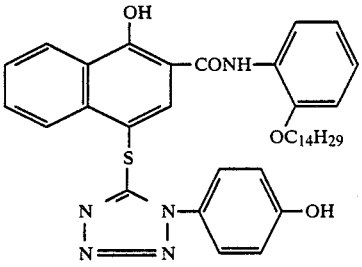
(D-9)
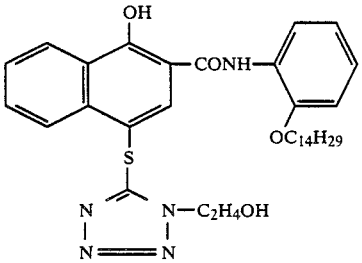
(D-10)
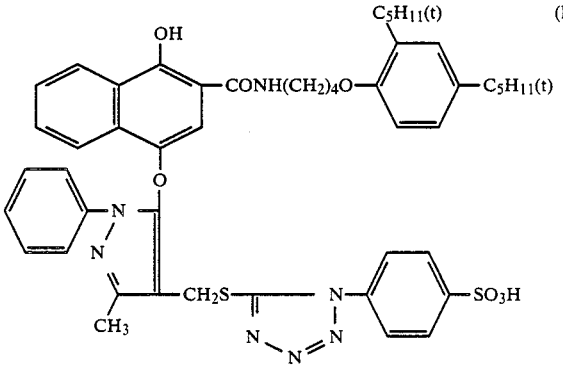

-continued
(D-11)
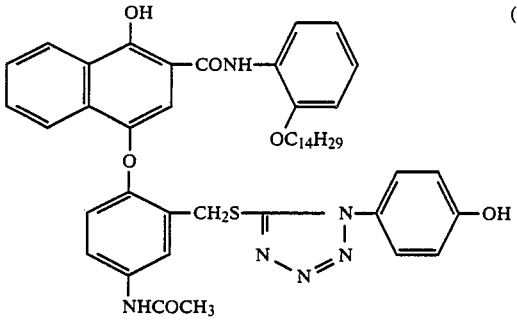
(D-12)
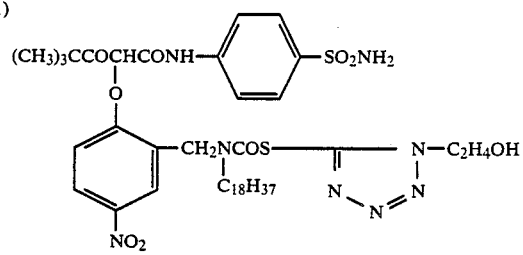
(D-13)
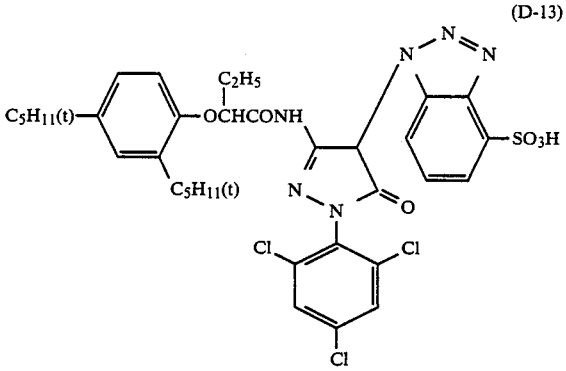
(D-14)
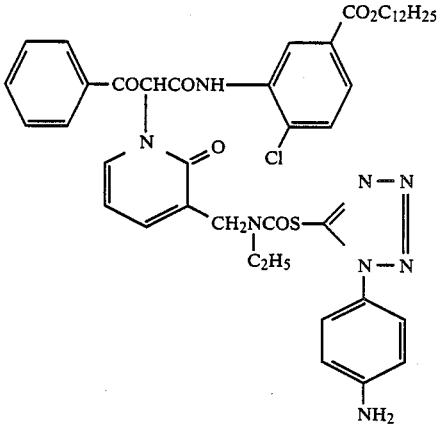
(D-15)
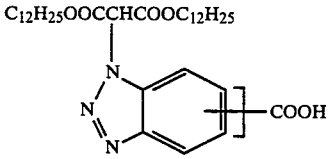
(D-16)
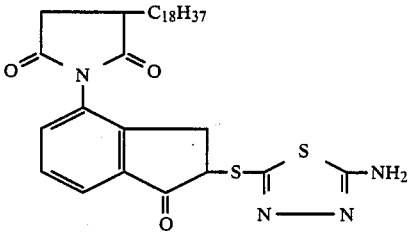
(D-17)
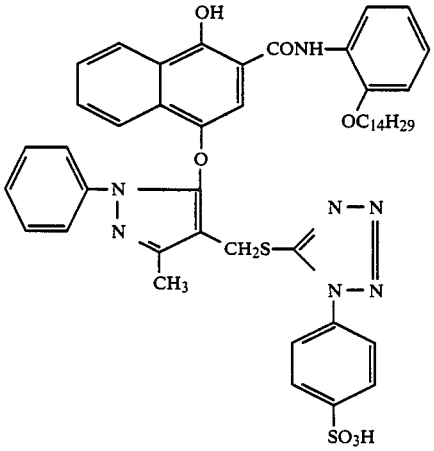
(D-18)
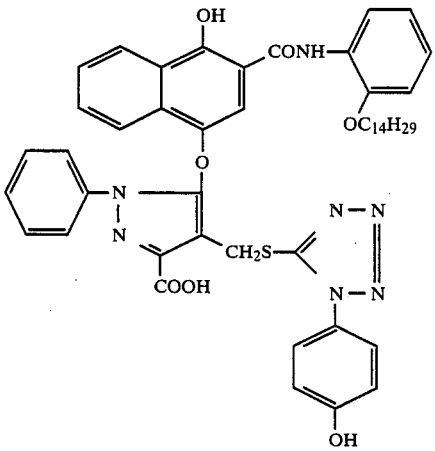
(D-19)
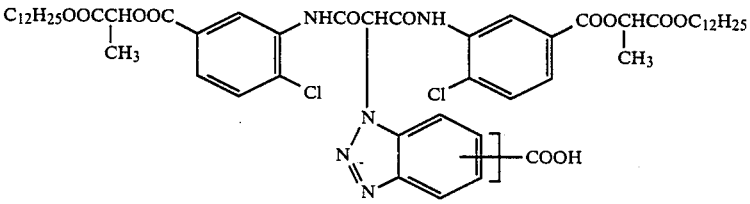

-continued
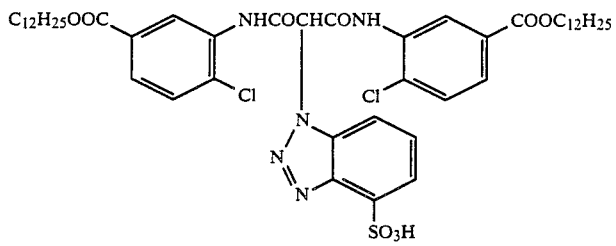
(D-20)
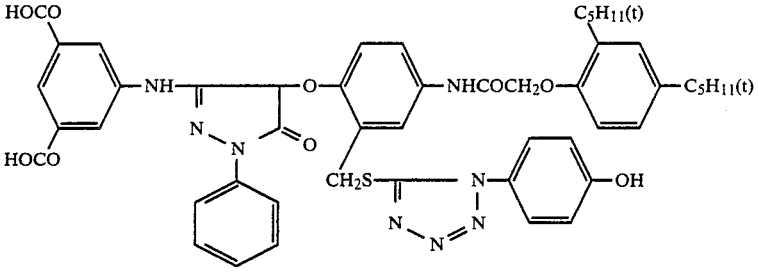
(D-21)
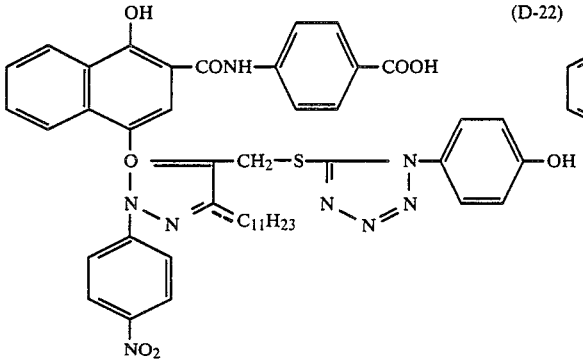
(D-22)
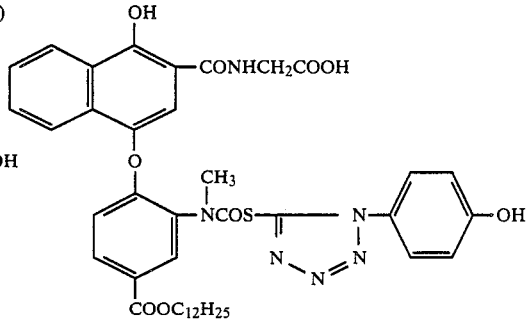
(D-23)
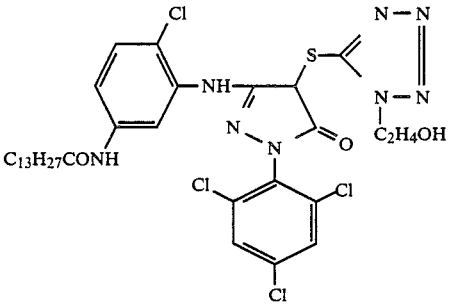
(D-24)
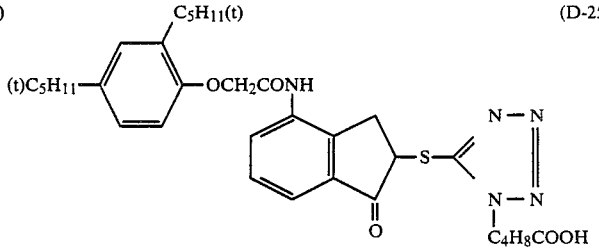
(D-25)
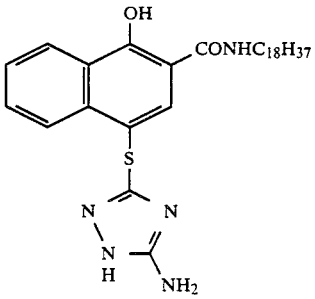
(D-26)
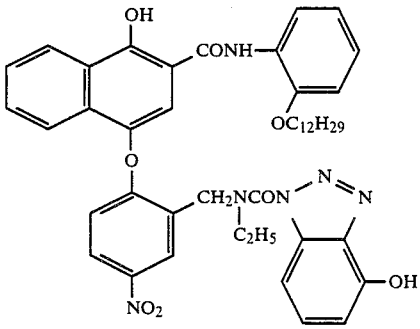
(D-27)

-continued
(D-28)
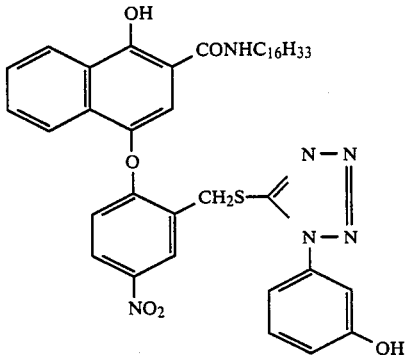
(D-29)
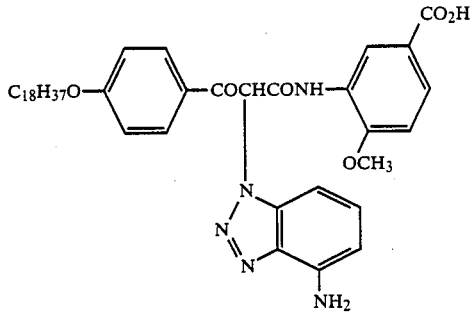
(D-30)
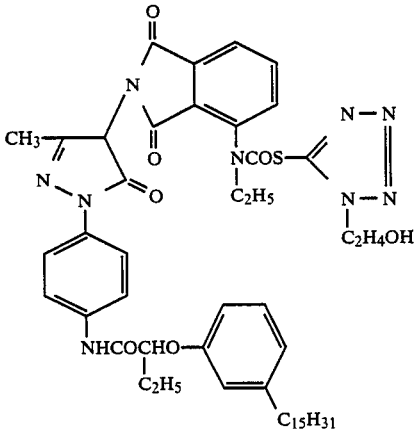
(D-31)
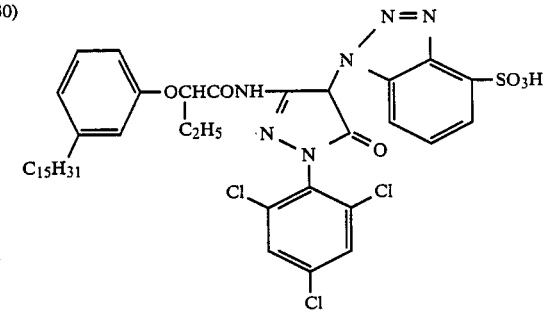
(D-32)
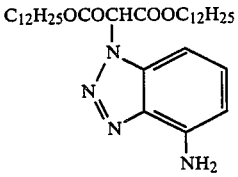
(D-33)
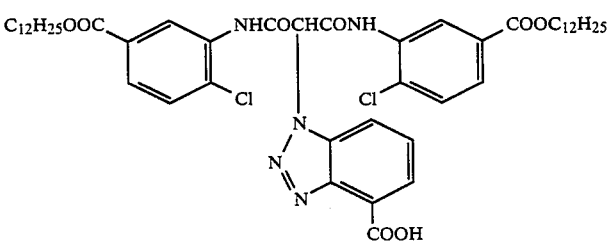

-continued
(D-34)
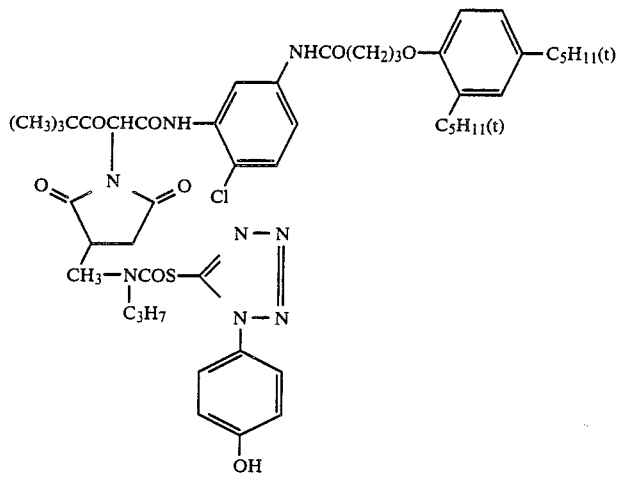
(D-35)
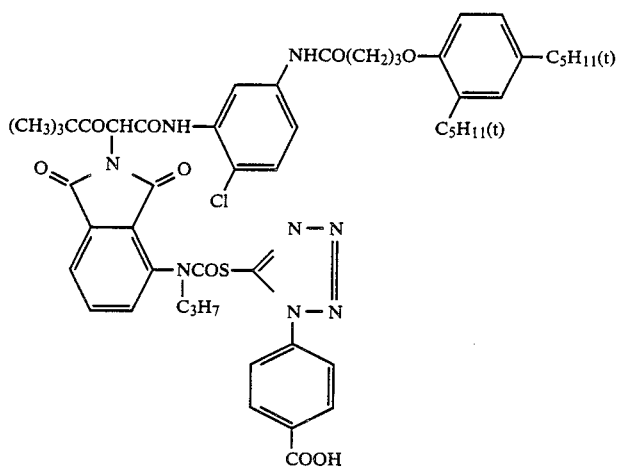
(D-36)
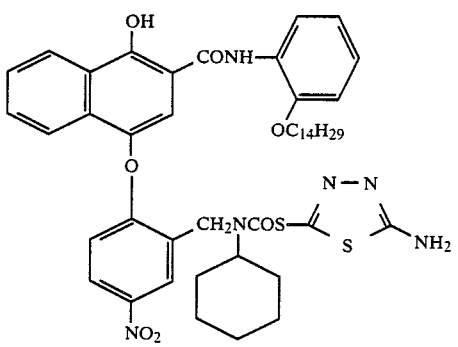
(D-37)
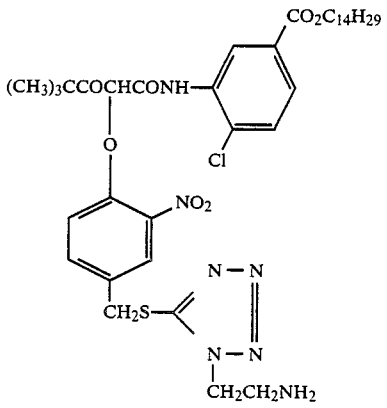

-continued
(D-38)
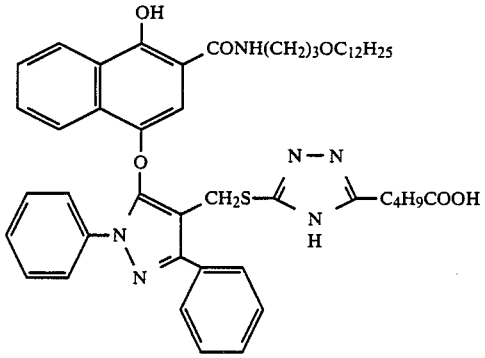
(D-39)
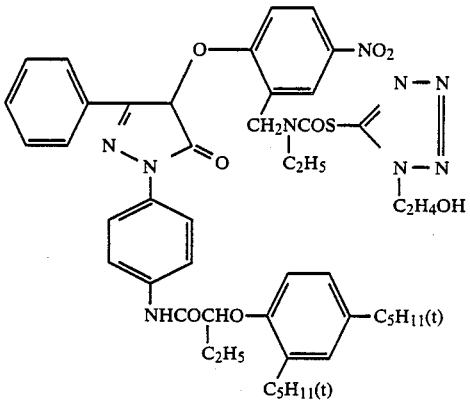
(D-40)
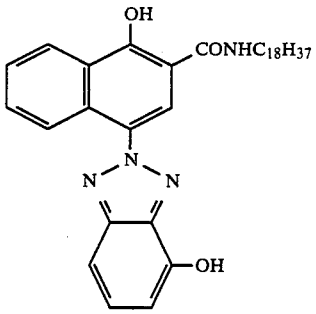
(D-41)
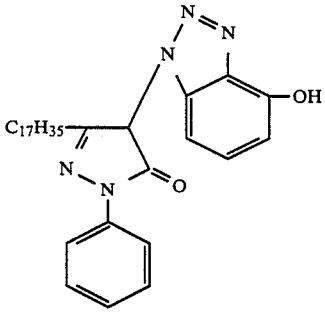
(D-42)
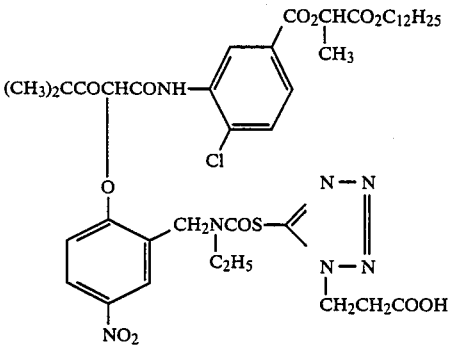
(D-43)
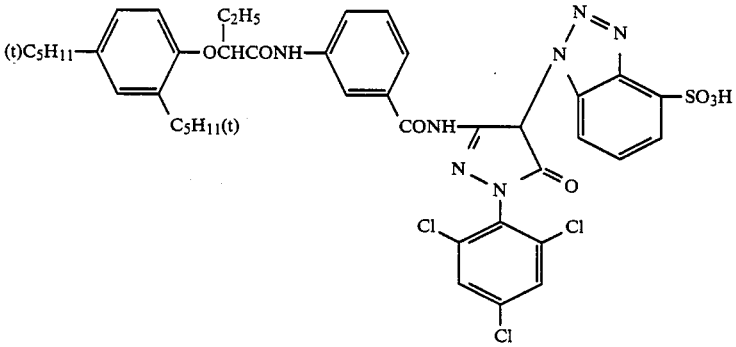

-continued
(D-44)
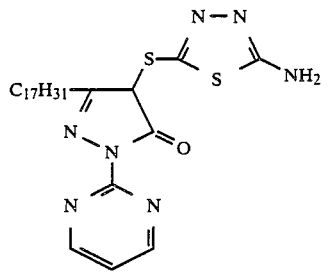
(D-45)
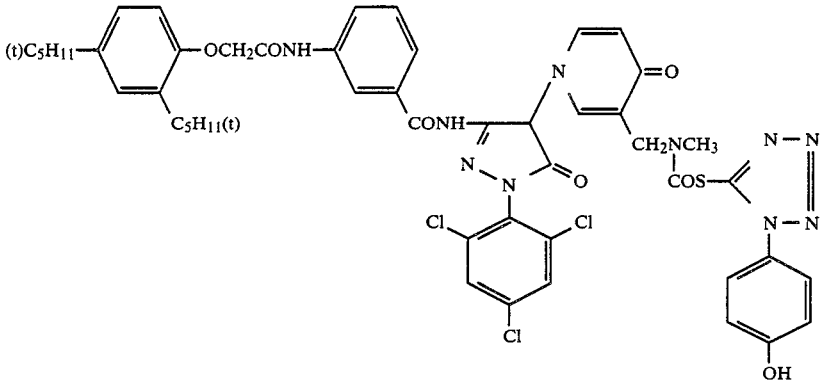
(D-46)
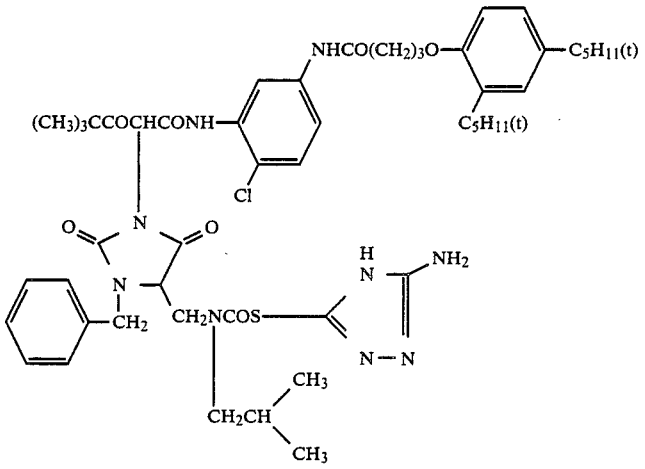
(D-47)
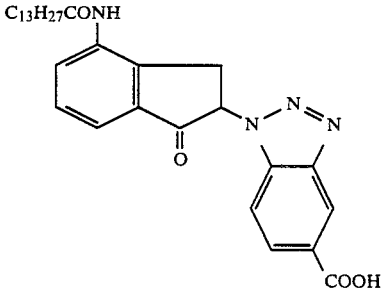
(D-48)
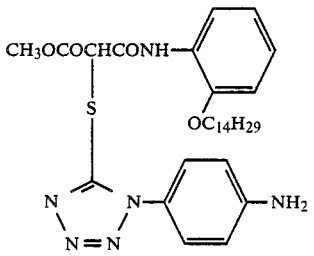

-continued
(D-49)
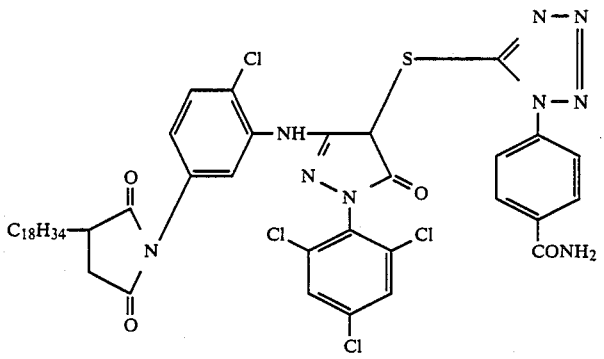
(D-50)
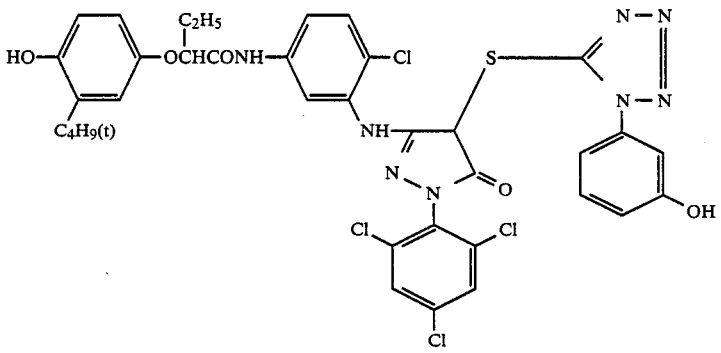
(D-51)
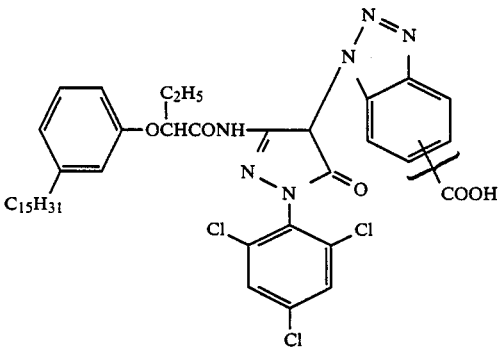
(D-52)
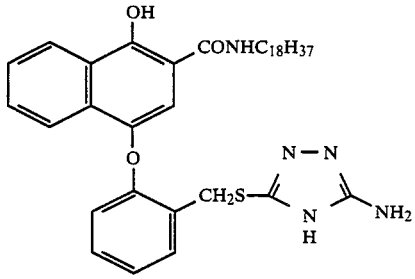
(D-53)
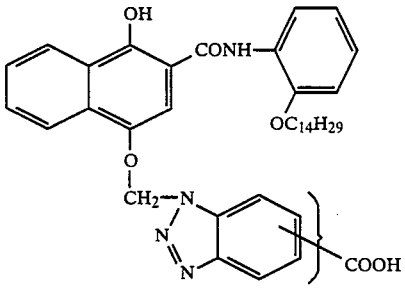
(D-54)
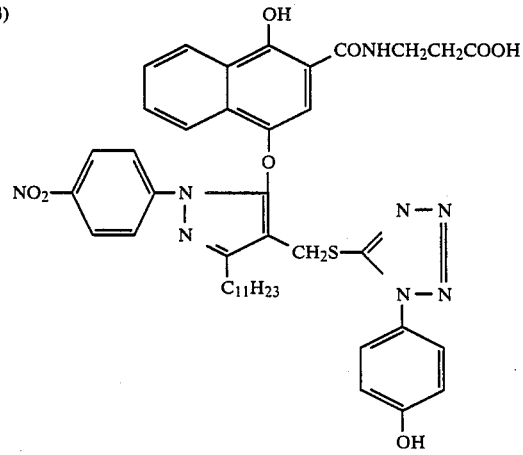

-continued
(D-55)
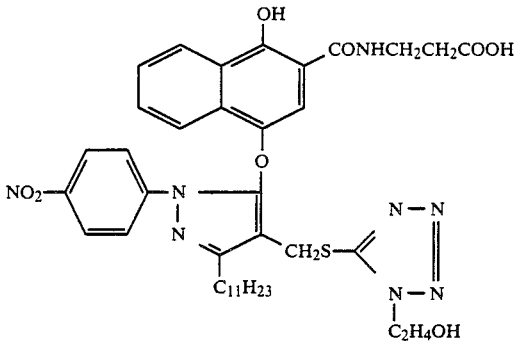
(D-56)
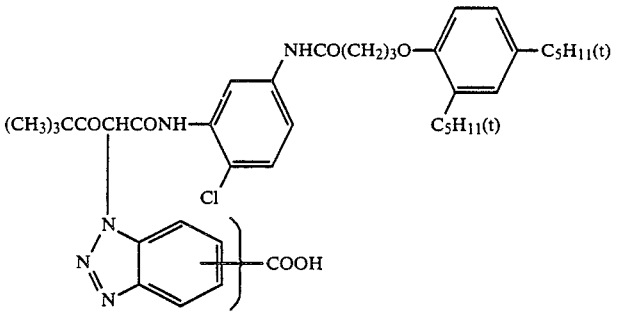
(D-57)
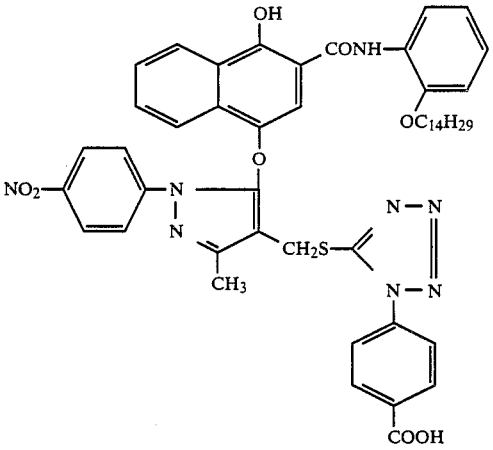
(D-58)
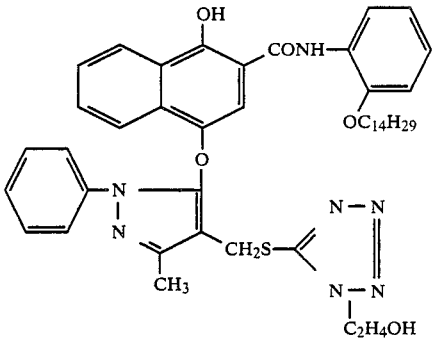
(D-59)
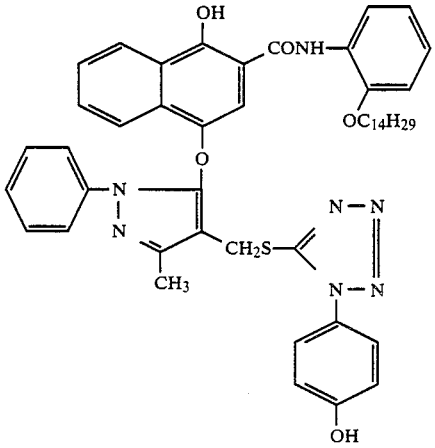
(D-60)
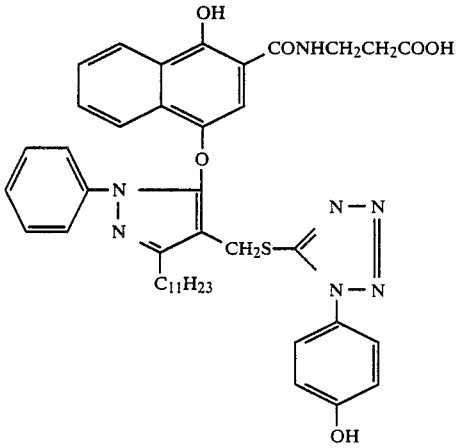

-continued
(D-61)
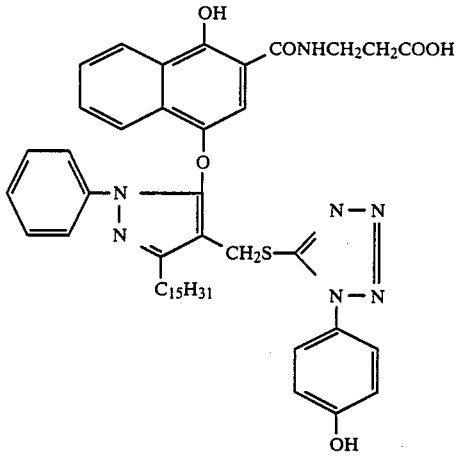
(D-62)
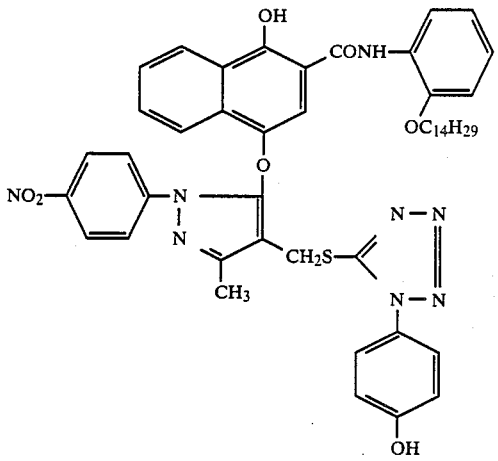
(D-63)
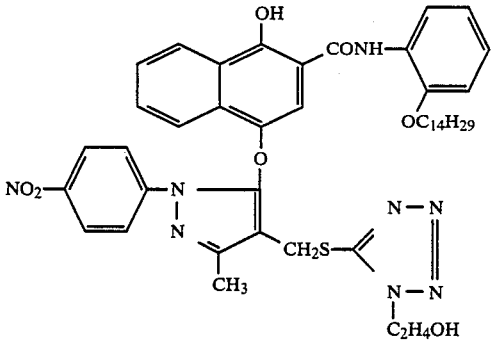
(D-64)
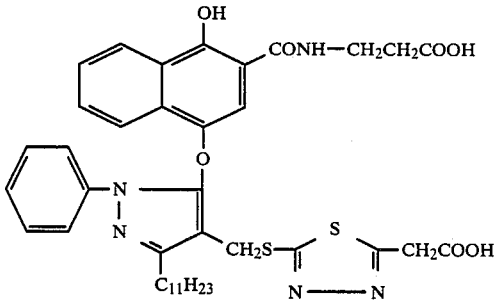
(D-65)
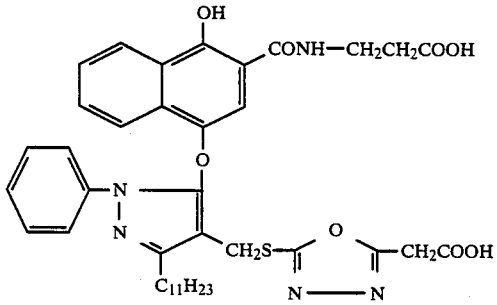
(D-66)
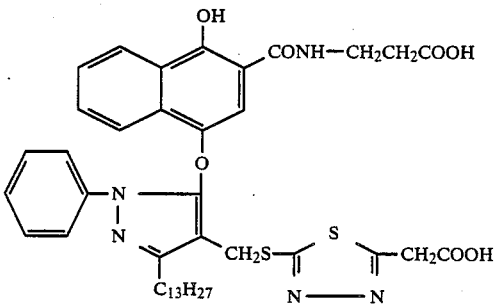
(D-67)
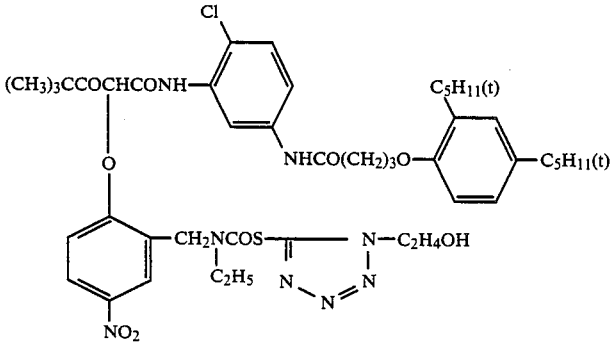

-continued (D-68)

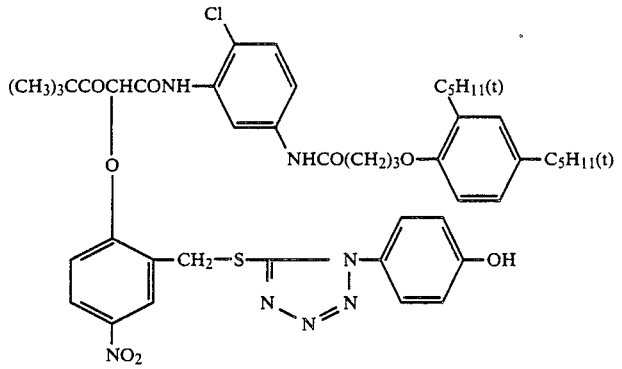

(D-69)

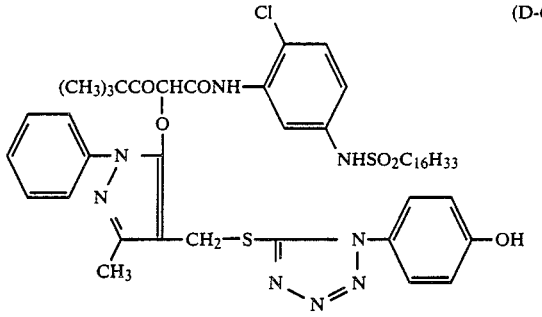

(D-70)

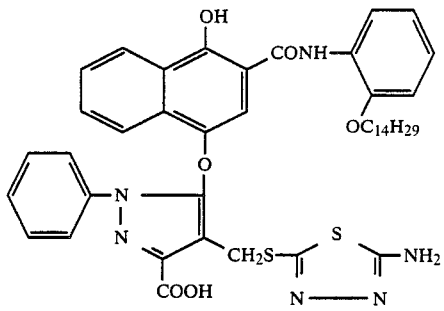

(D-71)

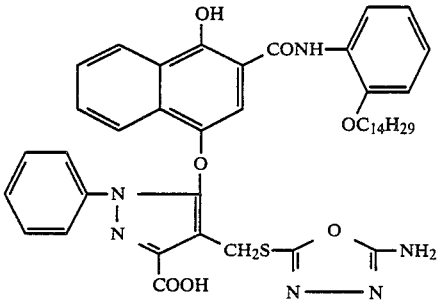

(D-72)

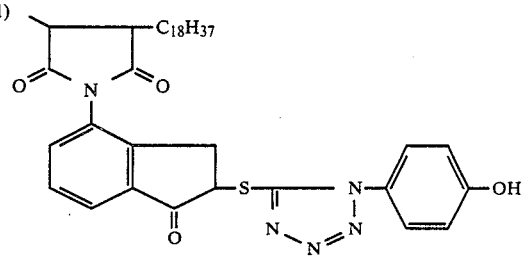

Any of the DIR compounds of this invention may be incorporated into photographic component layers, but is desirable to be incorporated into the light-sensitive silver halide emulsion layer and is particularly desired to be incorporated into a green-sensitive silver halide emulsion layer and/or a red-sensitive silver halide emulsion layer.

There is no special limitation to an amount of the DIR compounds of the invention to be added thereto. It is, however, desirable to add the DIR compounds of the invention in an amount of less than the range between 0.05 to 0.005 mol per mol of Ag that is a desired range in the ordinary case of improving an image sharpness, because the effects of the invention can be more displayed and there are less deteriorations in photographic characteristics such as a desensitization and a lowering of a maximum density and, more particularly desirable to add in an amount of from 0.0001 mol to 0.005 mol per mol of a silver content of the above-mentioned photographic component layer.

In the present invention, two or more different ones of the DIR compounds of this invention may be incorporated into the same layer, or the same DIR compound may be incorporated into two or more different layers.

In order to incorporate these DIR compounds into the coating liquid for the photographic component layers of this invention, the DIR compound, if alkali-soluble, may be incorporated in the form of an alkaline solution, and if oilsoluble, in accordance with any of those methods as described in U.S. Pat. Nos. 2,322,027, 2,801,170, 2,801,171, 2,272,191 and 2,304,940, is desirable to be dissolved in a high-boiling solvent, if necessary, in combination with a low-boiling solvent, to be in the finely dispersed liquid form to be incorporated into the silver halide emulsion. In this instance, if necessary, two or more different DIR compounds are allowed to be mixed to be used. Referring further in detail to the preferred method of incorporating the DIR compounds of the invention, one or two or more of the DIR compounds of this invention are dissolved into a high-boiling solvent and/or a low boiling solvent, and the resulting solution is then mixed with an aqueous solution containing an anionic and/or nonionic surfactant or a hydrophilic binder such as gelatin, and the mixture is then emulsifiedly dispersed by means of a high-speed mixer, colloid mill, ultrasonic disperser, or the like, and the dispersed liquid is subsequently added to the silver halide emulsion.

Alternatively, the above DIR compound may be dispersed by using the latex-dispersing method. The latex-dispersing method and the effect thereof are described in Japanese Pat. Nos. 74538/1974, 59932/1976 and 324552/1979, and Research Disclosure, Aug. 1976, No. 14850, p.77–79.

The silver halide emulsion to be used in this invention may be a polydisperse emulsion whose silver halide grain sizes are distributed widely, but is more desirable to be a monodisperse emulsion.

The above-mentioned monodisperse silver halide grains in this invention are those which, when observed through an electron-microscopic photo, appear to be mostly uniform in the shape as well as in the size and have a grain-size distribution as defined by the following equation; i.e., those silver halide grains whose grain size distribution is such that, when the grain sizes' standard deviation s is devided by the average grain size $\bar{r}$, the quotient is not more than 0.20, and preferably not more than 0.15.

$$s = \sqrt{\frac{\Sigma(r - \bar{r})^2 ni}{\Sigma ni}}$$

$$\frac{s}{\bar{r}} \leqq 0.20$$

The silver halide emulsion may be chemically sensitized by using those chemical sensitizers including sulfur sensitizers; selenium sensitizers; reduction sensitizers; noble-metallic sensitizers such as a water-soluble salts of ruthenium, palladium, platinum, rhodium, iridium, etc. These sensitizers may be used alone or in discretional combination.

The silver halide emulsion of this invention is chemically ripened with the addition of a sulfur-containing compound, and before, during or after the chemical ripening, into the emulsion may be incorporated at least one hydroxytetrazaindene and at least one of those nitrogen-containing heterocyclic compounds having a mercapto group.

The silver halide to be used in this invention may be optically sensitized.

The silver halide color photographic light-sensitive material of this invention may contain in the hydrophilic colloid layer thereof a water-soluble dye (AI dye) as a filter dye or for the purpose of antiirradiation and various other purposes.

The silver halide emulsion layers of this invention may contain appropriate couplers; i.e., compounds capable of forming dyes by the reaction thereof with the oxidized product of a color developing agent.

In the present invention, as the above-mentioned couplers, various yellow couplers, magenta couplers and cyan couplers may be used. These couplers may be of the so-called two-equivalent type or four-equivalent type.

Concrete examples of these yellow couples are those as described in U.S. Pat. Nos. 2,875,057, 3,265,506, 3,408,194, 3,551,155, 3,582,322, 3,725,072, 3,891,445, West German Patent No. 1,547,868, West German OLS Pat. Nos, 2,219,917, 2,261,361, 2,414,006, British Pat. No. 1,425,020, Japanese Patent Examined Publication No. 10783/1976, Japanese Patent O.P.I. Publication Nos. 26133/1972, 73147/1973, 102636/1976, 6341/1975, 123342/1975, 130442/1975, 21827/1976, 87650/1975, 82424/1977, 115219/1977, 95346/1983, and the like.

Magenta couplers usable in this invention include pyrazolone-type, pyrazolotriazole-type, pyrazolinobenzimidazole-type and indazolone-type compounds. These magenta couplers may be of not only the four-equivalent type but also the two-equivalent type as in the case of the above yellow couplers. Concrete examples of these magenta couplers are those as described in U.S. Pat. Nos. 2,600,788, 2,983,6008, 3,062,653, 3,127,269, 3,311,476, 3,419,391, 3,519,429, 3,558,319, 3,582,322, 3,615,506, 3,834,908, 3,891,445, West German Pat. Nos. 1,810,464, West German OLS Pat. Nos. 2,408,665, 2,417,945, 2,418,959, 2,424,467, Japanese Patent Examined Publication Nos. 6031/1965, Japanese Patent O.P.I. Publication Nos. 20826/1976, 58922/1977, 129538/1974, 74027/1974, 159336/1975, 42121/1977, 74028/1974, 60233/1975, 26541/1976, 55122/1978, Japanese Patent Application No. 110943/1980, and the like.

Useful cyan couplers usable in this invention include, e.g., phenol-type or naphthol-type cyan couplers. These cyan couplers may be of not only the four-equivalent type but also the two-equivalent type. Concrete examples of these cyan couplers are those as described in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411, 4,004,929, West German OLS Pat. Nos. 2,414,830, 2,454,329, Japanese Patent O.P.I. Publication Nos. 59838/1973, 26034/1976, 5055/1973, 146827/1976, 69624/1977, 90932/1977, 95346/1983, and the like.

The silver halide emulsion layers and other photographic component layers of this invention may contain polymer couplers in combination. As for such polymer couplers, reference can be made to the description in our Japanese Patent Application No. 172151/1984.

The addition of the above-mentioned couplers usable in this invention may be carried out in similar manner to the method described previously for the foregoing DIR compounds, and the adding quantity of the above couplers, although not definite, is preferably from $1\times10^{-3}$ to $5\times10^{-1}$ moles.

The silver halide color photographic light-sensitive material of this invention may also contain various photographic additives; for example, those antifoggants, stabilizers, ultraviolet absorbing agents, anticolorstain agents, brightening agents, antidiscoloration agents, antistatic agents, hardening agents, surfactants, plasticizers, wetting agents, and the like, as described in Research Disclosure 17643.

Materials usable as the reflective support of the silver halide color photographic light-sensitive material of this invention include, e.g., baryta paper, polyethylene-laminated paper, polypropylene synthetic paper, reflective layer-provided or reflective material-combined transparent support materials such as glass plates, cellulose acetate film, cellulose nitrate film, polyester film such as polyethylene terephthalate film, etc., polyamide film, polycarbonate film, polystyrene film, and the like. These reflective support materials may be used by arbitrarily selecting according to the purpose for which the light-sensitive material is used.

In the present invention, the respective emulsion layer's coating positions (order) can be arbitrarily arranged. For example, in the case of a light-sensitive material for fullcolor photographic paper use, it is desirable to arrange the blue-sensitive silver halide emulsion layer, green-sensitive silver halide emulsion layer and red-sensitive silver halide emulsion layer in the described order from the support side.

In this invention, it is discretional to provide proper thickness-having interlayers according to purposes, and further to provide in combination various component layers such as filter layers, an anticurl layer, a protective layer, an antihalation layer, and the like.

No particular restrictions are placed on the processing of the silver halide photographic light-sensitive material which uses the silver halide emulsion of this invention. Every appropriate processing method can apply; for example, a method of color developing, then bleach-fix, and, if necessary, washing and/or stabilizing; a method of color developing, bleaching and fixing separately, and, if necessary, washng and/or stabilizing; a method of prehardening, neutralizing, color developing, stop-fixing, washing, bleaching, fixing, washing, post-hardening, and then washing; a method of color developing, washing, supplementary color developing, stopping, bleaching, fixing, washing, and then stabilizing; a method in which the developed silver produced by color development is halogenation-bleached and then color-developed again to increase the produced amount of dye; and the like. Any of these methods may be used to process the light-sensitive material.

The above color developing agent is typified by p-phenylenediamine-type compounds.

According to this invention, a stable silver halide photographic light-sensitive material which is stably processed even when the mixing-in of a different processing component (so-called back contamination) occurs and whose photographic characteristics are maintained constant can be obtained.

EXAMPLES

The present invention will be illustrated further in detail by the following examples, but the embodiment of this invention is not limited thereto.

EXAMPLE 1

On a polyethylene-laminated paper support were coated the following layers in order from the support side, whereby silver halide color photographic light-sensitive material Sample No. 1 was prepared.

Layer 1 . . . A layer containing 1.2 g/m$^2$ of gelatin, 0.32 g/m$^2$ (silver equivalent; the same shall apply hereinafter) of a blue-sensitive silver chlorobromide emulsion (silver bromide content 80 mole %), and 0.80 g/m$^2$ of an yellow coupler (Y-1) dissolved in 0.50 g/m$^2$ of dioctyl phthalate.

Layer 2 . . . An interlayer comprising 0.7 g/m$^2$ of gelatin, 10 mg/m$^2$ of an antiirradiation dye (AI-1), and 5 mg/m$^2$ of (AI-2).

Layer 3 . . . A layer containing 1.25 g/m$^2$ of gelatin, 0.22 g/m$^2$ of a green-sensitive silver chlorobromide emulsion (silver bromide content 70 mole %), and 0.62 g/m$^2$ of a magenta coupler (M-1) dissolved in 0.30 g/m$^2$ of dioctyl phthalate.

Layer 4 . . . An interlayer comprising 1.2 g/m$^2$ of gelatin.

Layer 5 . . . A layer containing 1.40 g/m$^2$ of gelatin, 0.20 g/m$^2$ of a red-sensitive silver chlorobromide emulsion (silver bromide content 50 mole %), and 0.45 g/m$^2$ of a cyan coupler (C-1) dissolved in 0.20 g/m$^2$ of dioctyl phthalate.

Layer 6 . . . A layer containing 1.0 g/m$^2$ of gelatin and 0.30 g/m$^2$ of an ultraviolet absorbing agent (UV-1) dissolved in 0.20 g/m$^2$ of dioctyl phthalate.

Layer 7 . . . A layer comprising 0.5 g/m$^2$ of gelatin.

In addition, a hardener sodium 2,4-dichloro-6-hydroxy-S-triazine was added in a quantity of 0.017 g per gram of gelatin to Layers 2, 4 and 7.

Further, Samples No. 2 through No. 4 were prepared in the same manner as in Sample No. 1 except that the DIR couplers given in Table 1 were added to Layers 1, 3 and 5. On the other hand, for comparison, Samples No. 5 and No. 6 were prepared in the manner as Sample No. 1, except that the comparative DIR couplers DD-1 and DD-2 were added, respectively, which have no hydrophilic groups on their development inhibiting groups. Samples No. 7 and No. 8 were both added the DIR coupler of this invention but the amount of the DIR coupler were larger than the range of the invention. Samples No. 9 and No. 10 were prepared in the same manner as in Sample No. 1 except that the following development inhibitors Z-1 and Z-2 were added to Layers 1, 3 and 5.

(DD-1)

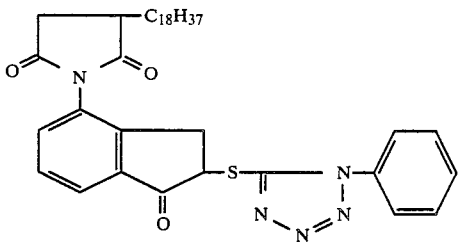

(DD-2)

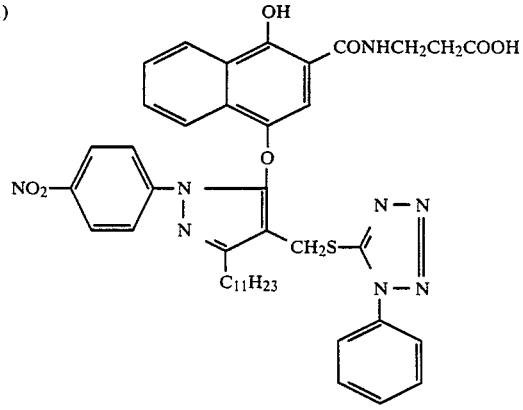

-continued (Y-1)

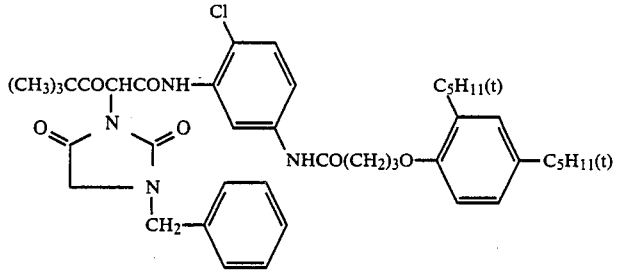

(M-1)

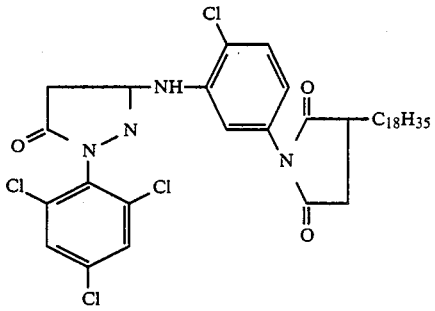

(C-1)

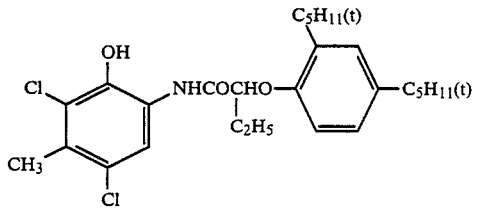

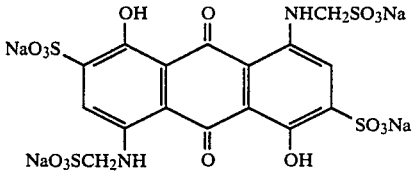

(AI-1)

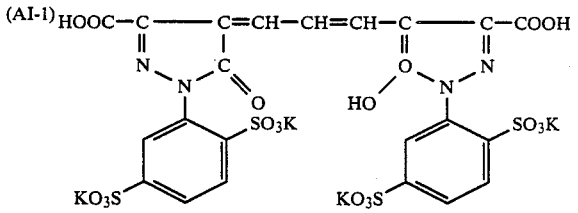

(AI-2)

(UV-1)

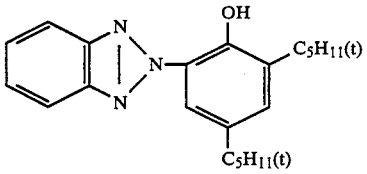

The above light-sensitive material Samples No. 1 through No. 10 each was exposed thorugh an optical wedge to light, and then processed in the following steps:

Processing steps (38° C.)

| | |
|---|---|
| Color developing | 3 minutes and 30 seconds |
| Bleach-fix | 1 minute |
| Washing | 1 minute |
| Drying | 2 minutes at 60–80° C. |

The compositions of the respective processing liquids are as follows:

[Color Developer]

| | |
|---|---|
| Pure water | 800 ml |
| Benzyl alcohol | 15 ml |
| Hydroxyamine sulfate | 2.0 g |
| Potassium bromide | 1.3 g |
| Sodium chloride | 1.0 g |
| Potassium sulfite | 2.0 g |
| Triethanolamine | 2.0 g |
| N—ethyl-N—β-methansulfonamidoethyl-3-methyl-4-aminoaniline sulfate | 4.5 g |
| 1-hydroxyethylidene-1,1-diphosphonic acid (aqueous 60% solution) | 1.5 ml |
| Potassium carbonate | 32.0 g |
| Whitex BB (aqueous 50% solution) (brightening agent, product of Sumitomo Chem. Ind. Co.) | 2.0 ml |

Add pure water to make 1 liter.

Use 20% potassium hyroxide or 10% dilute sulfuric acid to adjust the pH to 10.1.

[Bleach-Fix Bath]

| | |
|---|---|
| Pure water | 550 ml |
| Iron (III)-ammonium ethylenediaminetetra-acetate | 65 g |
| Ammonium thiosulfate | 85 g |
| Sodium hydrogensulfite | 10 g |
| Sodium metabisulfite | 2 g |
| Disodium ethylenediaminetetraacetate | 20 g |
| Sodium bromide | 10 g |

Add pure water to make 1 liter.

Use aqueous ammonia or dilute sulfuric acid to ajust the pH to 7.0.

The obtained respective samples were subjected to sensitometry tests. The sensitivity (S) and gamma value (γ) of each sample were found.

Further, the bleach-fix solution was added in a quantity of 0.2 ml/liter and also in a quantity of 0.4 ml/liter to the foregoing color developer solution, and the solutions were used to process the above Samples No. 1 through No. 10 in like manner to thereby find gamma values (γ).

The results are shown in Table 2 and Table 3.

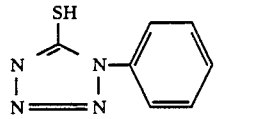

Z-1

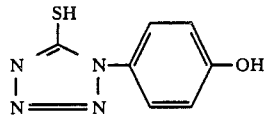

Z-2

TABLE 1

| Sample No. | Layer 1 DIR cpd. or inhibitor | Layer 1 Adding q'ty (mg/m²) | Layer 2 DIR cpd. or inhibitor | Layer 2 Adding q'ty (mg/m²) | Layer 3 DIR cpd. or inhibitor | Layer 3 Adding q'ty (mg/m²) |
|---|---|---|---|---|---|---|
| 1 | none | — | none | — | none | — |
| 2 | D-72 | 3 | D-54 | 6 | D-11 | 5 |
| 3 | D-72 | 3 | D-72 | 5 | D-72 | 5 |
| 4 | D-54 | 3 | D-54 | 6 | D-54 | 6 |
| 5 | DD-1 | 3 | DD-1 | 5 | DD-1 | 5 |
| 6 | DD-2 | 3 | DD-2 | 6 | DD-2 | 6 |
| 7 | D-72 | 15 | D-54 | 30 | D-11 | 25 |
| 8 | D-72 | 15 | D-72 | 25 | D-72 | 25 |
| 9 | Z-1 | 1.0 | Z-1 | 1.0 | Z-1 | 1.0 |
| 10 | Z-2 | 1.0 | Z-2 | 1.0 | Z-2 | 1.0 |

TABLE 2

| Sample No. | R S | R γ | O S | O γ | P S | P γ |
|---|---|---|---|---|---|---|
| 1 | 100 | 3.00 | 100 | 3.31 | 100 | 3.52 |
| 2 | 98 | 2.98 | 97 | 3.30 | 97 | 3.50 |
| 3 | 99 | 2.96 | 98 | 3.27 | 96 | 3.48 |
| 4 | 97 | 2.94 | 95 | 3.23 | 93 | 3.46 |
| 5 | 94 | 2.86 | 92 | 3.10 | 90 | 3.31 |
| 6 | 90 | 2.84 | 88 | 3.09 | 86 | 3.28 |
| 7 | 89 | 2.82 | 86 | 2.97 | 87 | 3.23 |
| 8 | 88 | 2.79 | 88 | 3.05 | 86 | 3.12 |
| 9 | 32 | 1.87 | 28 | 1.92 | 30 | 2.05 |
| 10 | 54 | 2.23 | 41 | 2.44 | 45 | 2.64 |

Note:
R: Blue-sensitive silver halide emulsion, the same shall apply hereinafter.
O: Green-sensitive silver halide emulsion, the same shall apply hereinafter.
P: Red-sensitive silver halide emulsion, the same shall apply hereinafter.

Sensitivity S indicates a value relative to the value of Sample No. 1 which is regarded as 100, The values of gamma are indicated by a gamma of a straight line connecting a density points 0.8 and 1.8 on the characteristic line.

TABLE 3

| Sample No. | | Bleach-fix sol. ml/liter of color dev. sol. 0 | 0.2 | 0.4 | Variation width* Δγ |
|---|---|---|---|---|---|
| 1 R | Other than | 3.00 | 3.32 | 3.69 | 0.69 |
| O | the Invention | 3.31 | 4.01 | 4.52 | 1.21 |
| P | | 3.52 | 3.83 | 4.28 | 0.76 |
| 2 R | This | 2.98 | 3.02 | 3.09 | 0.11 |
| O | invention | 3.30 | 3.35 | 3.40 | 0.10 |
| P | | 3.50 | 3.56 | 3.62 | 0.12 |
| 3 R | This | 2.96 | 3.07 | 3.14 | 0.18 |
| O | invention | 3.27 | 3.38 | 3.44 | 0.17 |
| P | | 3.48 | 3.60 | 3.69 | 0.21 |
| 4 R | This | 2.94 | 3.01 | 3.06 | 0.12 |
| O | invention | 3.23 | 3.30 | 3.34 | 0.11 |
| P | | 3.46 | 3.55 | 3.60 | 0.14 |
| 5 R | Other than | 2.86 | 2.99 | 3.10 | 0.24 |
| O | the Invention | 3.10 | 3.25 | 3.37 | 0.27 |
| P | | 3.31 | 3.44 | 3.54 | 0.23 |
| 6 R | Other than | 2.84 | 3.00 | 3.05 | 0.21 |
| O | the Invention | 3.09 | 3.21 | 3.32 | 0.23 |
| P | | 3.28 | 3.38 | 3.48 | 0.20 |
| 7 R | Other than | 2.82 | 2.93 | 3.02 | 0.20 |
| O | the Invention | 2.97 | 3.09 | 3.18 | 0.21 |
| P | | 3.23 | 3.40 | 3.46 | 0.23 |
| 8 R | Other than | 2.79 | 2.96 | 3.07 | 0.28 |
| O | the Invention | 3.05 | 3.21 | 3.30 | 0.25 |
| P | | 3.12 | 3.31 | 3.43 | 0.31 |
| 9 R | Other than | 1.87 | 1.93 | 1.99 | 0.12 |
| O | the Invention | 1.92 | 2.02 | 2.21 | 0.23 |
| P | | 2.05 | 2.13 | 2.18 | 0.13 |
| 10 R | Other than | 2.23 | 2.29 | 2.33 | 0.10 |
| O | the Invention | 2.44 | 2.54 | 2.62 | 0.18 |
| P | | 2.64 | 2.73 | 2.77 | 0.13 |

Note:
*Variation width: $\Delta\gamma = |\gamma(0) - \gamma(0.4)|$ wherein, for example, γ(0.4) represents the gamma values obtained when 0.4 ml of the bleach-fix solution was added.

As is apparent from Tables 2 and 3, Samples No. 2 through No. 4 each containing the DIR couplers of the invention respectively show a remarkable improvement in the prevention of a high contrast due to the back contamination in the bleach-fixer components without being accompanied with any deterioration of photographic characteristics such as desensitization, softening of gradation and the like.

In contrast to the above, Sample No. 1 containing no DIR coupler of the invention shows a wide gamma variation due to the back contamination. In Samples No. 5 and No. 6, the effects of the invention can be displayed only a little and the lowering of sensitivity and gamma are also in evidence.

Further, in Samples No. 7 and No. 8 each containing the DIR couplers of the invention in such as amount of the order of 0.01 mol of Ag as is usually added in the ordinary cases of improving an image sharpness, the invention is diminished in effects and some lowering of sensitivity and softening of gradation are also in evidence.

On the other hand, in Samples No. 9 and No. 10 each containing development inhibitors Z-1 and Z-2, the sensitivity and gamma thereof are seriously lowered, so that the objects of the invention can not be achieved thereby.

EXAMPLE 2

Similarly tests were made in the same manner as in Example 1 except that 2 mg of Exemplified Compound D-72 and 1 mg of Exemplified Compound D-54 were incorporated into the Layer 1 of Example 1, 3 mg of Exemplified Compound D-72 and 3 mg of Exemplified Compound D-54 into the Layer 3, and 3 mg of Exemplified Compound D-72 and 3 mg of Exemplified Compound D-64 into the Layer 5. Consequently, as satisfactory results as in Example 1 were obtained.

EXAMPLE 3

Samples No. 11 through No. 20 were prepared in the same manner as in Sample No. 1 through No. 10 of Example 1, except that the silver halide emulsions of Layers 1, 3 and 5 were replaced by the same amount of silver chloride (AgCl) emulsions, respectively.

Each of the resulted Sample No. 11 through No. 20 was exposed to light through an optical wedge and was then processed in the following steps:

Processing steps

| | Temperature | Time |
|---|---|---|
| Color developing | 34.7 ± 0.3° C. | 45 sec |
| Bleach-fixing | 34.7 ± 0.5° C. | 50 sec |
| Stabilizing | 30 to 34° C. | 90 sec |
| Drying | 60 to 80° C. | 60 sec |

[Color Developer-A]

| | |
|---|---|
| Pure water | 800 ml |
| Triethanolamine | 8 g |
| N,N—diethylhydroxylamine | 5 g |
| Potassium chloride | 2 g |
| N—ethyl-N—β-methanesulfonamidoethyl-3-methyl 4-aminoaniline sulfate | 5 g |
| Sodium tetrapolyphosphate | 2 g |
| Potassium carbonate | 30 g |
| Potassium sulfite | 0.2 g |
| Brightening agent (4,4'-diaminostilbene sulfonic acid derivative) | 1 g |

Pure water to be added to make 1 liter in total.
pH value to be adjusted to pH10.2.
[Bleach-fixer-A]

| | |
|---|---|
| Ferric ammonium ethylenediamine-tetraacetatodihydrate | 60 g |
| Ethylenediaminetetraacetic acid | 3 g |
| Ammonium thiosulfate (a 70% solution) | 100 ml |
| Ammonium sulfite (a 40% solution) | 27.5 ml |

pH value to be adjusted to pH 5.7 with potassium carbonate or glacial acetic acid.

Water to be added to make 1 liter in total.

[Stabilizer]

| | |
|---|---|
| 5-chloro-2-methyl-4-isothiazoline-3-one | 1 g |
| 1-hydroxyethylidene-1,1-diphosphonic acid | 2 g |

Water to be added to make 1 liter.

pH value to be adjusted to pH 7.0 with sulfuric acid or potassium hydroxide.

The resulted samples were subjected to sensitometric tests in an ordinary procedure to obtain the respective sensitivity (s) and gamma values (γ).

Further, the bleach-fixer was added in the aforegoing color developer in each of the proportions of 0.2 ml and 0.4 ml per liter of the developer, respectively. The resulted samples were treated in the same manner to obtain the gamma values (γ) thereof.

The results are shown in Tables 4 and 5.

TABLE 4

| | R | | O | | P | |
|---|---|---|---|---|---|---|
| Sample No. | S | γ | S | γ | S | γ |
| 11 | 100 | 3.03 | 100 | 3.27 | 100 | 3.41 |
| 12 | 97 | 2.95 | 97 | 3.26 | 98 | 3.40 |
| 13 | 99 | 2.91 | 99 | 3.24 | 97 | 3.39 |
| 14 | 98 | 2.93 | 96 | 3.21 | 94 | 3.37 |
| 15 | 93 | 2.81 | 94 | 3.17 | 88 | 3.36 |
| 16 | 91 | 2.76 | 89 | 3.04 | 84 | 3.32 |
| 17 | 87 | 2.79 | 83 | 2.92 | 86 | 3.29 |
| 18 | 85 | 2.68 | 84 | 3.05 | 82 | 3.21 |
| 19 | 24 | 1.21 | 23 | 1.68 | 25 | 1.76 |
| 20 | 31 | 2.03 | 37 | 2.32 | 33 | 2.43 |

TABLE 5

| | Bleach-fixer in ml/ Color developer in liter | | | Variation range |
|---|---|---|---|---|
| Sample No. | 0 | 0.2 | 0.2 | Δγ |
| 11 R | 3.03 | 3.40 | 3.78 | 0.75 |
| O | 3.27 | 3.43 | 4.62 | 1.35 |
| P | 3.41 | 3.92 | 4.34 | 0.93 |
| 12 R | 2.95 | 2.99 | 3.06 | 0.11 |
| O | 3.26 | 3.31 | 3.35 | 0.09 |
| P | 3.40 | 3.45 | 3.51 | 0.09 |
| 13 R | 2.91 | 3.02 | 3.09 | 0.18 |
| O | 3.24 | 3.34 | 3.43 | 0.19 |
| P | 3.39 | 3.48 | 3.61 | 0.22 |
| 14 R | 2.93 | 2.98 | 3.04 | 0.11 |
| O | 3.21 | 3.25 | 3.31 | 0.10 |
| P | 3.37 | 3.44 | 3.50 | 0.13 |
| 15 R | 2.81 | 2.93 | 3.06 | 0.25 |
| O | 3.17 | 3.32 | 3.47 | 0.30 |
| P | 3.36 | 3.48 | 3.59 | 0.23 |
| 16 R | 2.76 | 2.89 | 3.00 | 0.24 |
| O | 3.04 | 3.16 | 3.27 | 0.23 |
| P | 3.32 | 3.41 | 3.51 | 0.19 |
| 17 R | 2.79 | 2.89 | 2.98 | 0.19 |
| O | 2.92 | 3.04 | 3.16 | 0.24 |
| P | 3.29 | 3.40 | 3.50 | 0.21 |
| 18 R | 2.68 | 2.84 | 2.98 | 0.30 |
| O | 3.05 | 3.21 | 3.32 | 0.27 |
| P | 3.21 | 3.38 | 3.50 | 0.29 |
| 19 R | 1.21 | 1.39 | 1.57 | 0.36 |
| O | 1.68 | 1.84 | 1.96 | 0.28 |
| P | 1.76 | 1.86 | 1.93 | 0.17 |
| 20 R | 2.03 | 2.09 | 2.13 | 0.10 |
| O | 2.32 | 2.41 | 2.48 | 0.16 |
| P | 2.43 | 2.50 | 2.56 | 0.13 |

As is apparent from Tables 4 and 5, Samples No. 12 through No. 18 each containing the DIR couplers of the invention show a substantial improvement to prevent the increase in the contrast which is caused by the back contamination of the bleach-fixer components without being accompanied by any deterioration of photographic characteristics such as desensitization, softening of gradation and the like.

What is claimed is:

1. A silver halide color photographic light-sensitive material comprising a reflective support having thereon photographic component layers including at least one silver halide emulsion layer, wherein each said silver halide emulsion layer contains silver halide grains consisting essentially of silver chlorobromide or silver chloride, and at least one of said photographic component layers contains at least one compound of the general formula [I]:

$$A-(TIME)_n-Z$$

wherein A is a coupler component capable of coupling with the oxidized product of a color developing agent and releasing —(TIME)n—Z, TIME being a timing group capable of releasing together with Z from A upon the coupling reaction of A with the oxidized product of the color developing agent, n being 0 or 1, and Z being a component capable of releasing from TIME and inhibiting the development of the silver halide, which has at least one hydrophilic group.

2. The light-sensitive material of claim 1, wherein a content of said compound selected from the compounds represented by the general formula [I] is from 0.0001 to 0.005 mole per mole of silver contained in said photographic component layers.

3. The light-sensitive material of claim 1, wherein a content of silver chloride of said silver chlorobromide emulsion is not less than 90 mol %.

4. The material of claim 3 wherein Z is a heterocyclic group or a heterocyclic thio group, which has at least one hydrophilic group.

5. The material of claim 3 wherein said hydrophilic group is a hydroxy group, a sulfo group, an amino group, a carboxy group, or a carbamoyl group.

6. The material of claim 3 wherein at least one silver halide emulsion layer contains said compound.

7. The light-sensitive material of claim 3 wherein each said silver halide emulsion layer contains said compound.

8. The material of claim 4 wherein said hydrophilic group is a hydroxy group, a sulfo group, an amino group, a carboxy group, or a carbamoyl group.

* * * * *